US008990971B2

(12) United States Patent
Carter

(10) Patent No.: US 8,990,971 B2
(45) Date of Patent: Mar. 31, 2015

(54) LOAD BEARING TACTICAL VEST FRAME

(75) Inventor: Paul Carter, Fayetteville, NC (US)

(73) Assignee: Archanged Armor LLC, Fayetteville, NC (US)

( * ) Notice: Subject to any disclaimer, the term of this patent is extended or adjusted under 35 U.S.C. 154(b) by 783 days.

(21) Appl. No.: 12/863,225

(22) PCT Filed: Jan. 16, 2009

(86) PCT No.: PCT/US2009/031289

§ 371 (c)(1),
(2), (4) Date: Feb. 3, 2011

(87) PCT Pub. No.: WO2009/092006

PCT Pub. Date: Jul. 23, 2009

(65) Prior Publication Data

US 2011/0120295 A1 May 26, 2011

Related U.S. Application Data

(60) Provisional application No. 61/006,499, filed on Jan. 16, 2008, provisional application No. 61/096,458, filed on Sep. 12, 2008.

(51) Int. Cl.
*A63B 71/12* (2006.01)
*A45F 3/06* (2006.01)
*A45F 3/10* (2006.01)

(52) U.S. Cl.
CPC .... *A45F 3/06* (2013.01); *A45F 3/10* (2013.01)
USPC ..... 2/462; 2/463; 2/464; 2/467; 2/2.5; 224/633; 224/635

(58) Field of Classification Search
CPC ..... A45F 3/14
USPC ..... 2/2.5, 93, 69, 102, 94, 108, 326–334, 2/114, 48, 456, 460–463, 467, 44, 45, 50, 2/51, 69.5; 224/633, 635, 636, 637, 649
See application file for complete search history.

(56) References Cited

U.S. PATENT DOCUMENTS 3,357,613 A * 12/1967 Chase ..... 224/162
2005/0005342 A1* 1/2005 Johnson ..... 2/102
2006/0208024 A1* 9/2006 Gleason, Jr. ..... 224/633

* cited by examiner

*Primary Examiner* — Danny Worrell
*Assistant Examiner* — Khaled Annis

(57) ABSTRACT

A load bearing vest comprising a yoke, a core for carrying armor attached to the yoke, and a waist belt assembly for distributing weight to the waist or hips of a user attached to the yoke.

3 Claims, 22 Drawing Sheets

LOAD BEARING TACTICAL VEST FRAME

CROSS-REFERENCE TO RELATED APPLICATIONS

This application is a National Stage Entry of PCT Application No. PCT/US2009/31289 filed Jan. 16, 2009, which claims the benefit of each of U.S. Provisional Application No. 61/006,499, filed Jan. 16, 2008, and U.S. Provisional Application No. 61/096,458, filed Sep. 12, 2008; each of which is incorporated herein in its entirety by reference.

BACKGROUND

The technology disclosed herein pertains to body armor. More particularly, the disclosed technology pertains to a load bearing vest for tactical use.

The modern battlefield is more dangerous than ever. Improved munitions have dramatically increased the probability of multiple injuries to combatants. These munitions increase the number and severity of the injuries. Typical tactical vest systems are built to carry all of the soldier's equipment weight directly on the shoulders and neck of the soldiers. One effect of this is decreased range of motion, mobility, of the entire upper body as well as early fatigue, exhaustion, lack of agility, mobility, and maneuverability. In summary, the heavy load the American warfighter is required to carry, while equipping him, may actually decrease his combat effectiveness. Military medical treatment shows an increasing number of injuries to soldiers originating from long term spinal load bearing, many of which have long term debilitating injuries which have caused many soldiers to be placed on limited duty, permanent profiles and even medically discharged from the army.

SUMMARY

A load bearing vest comprising a yoke, a carrier for carrying armor attached to the yoke, and a waist belt assembly for distributing weight to the waist or hips of a user attached to the yoke.

DETAILED DESCRIPTION

As required, detailed features and embodiments of the invention are disclosed herein. However, it is to be understood that the disclosed features and embodiments are merely exemplary of the technology that may be embodied in various and alternative forms. The figures are not necessarily to scale, and some features may be exaggerated or minimized to show details of particular components. Therefore, specific structural and functional details disclosed herein, and any particular combination of these details, are not to be interpreted as limiting, but merely as a basis for claims and as a representative basis for teaching one skilled in the art to variously employ the technology.

The technology relates to antiballistic systems, and more particularly to a versatile human body torso guard, that is light weight, modular in design which allows full range of motion and articulation of the shoulders and neck, including an internal frame (yoke and waist belt assembly) which supports the natural spinal alignment and disperses weight placed on it (as a load bearing system). The technology benefits individual soldiers, policemen and like personnel.

The technology relates to the carrier for the ballistic material, which is an outer shell or carrier of abrasion-, moisture- and flame-resistant pliable materials. The outer shell or carrier is provided with a series of straps and fasteners for anchoring to the torso and securing the carrier to an internal frame (yoke and waist belt). The outside of the carrier shall have attached various webbing and fasteners to attach tactical gear. The outer cover provides surface area for equipment, and the internal frame allows dispersion of this weight safely off of the shoulders and back and back onto the hips. The plate carrier rests on the front inside of the MOLLE panel, and on the back webbed onto the rear of the carrier. These components are modular in design to allow desirable placement for the user.

Reference will now be made in detail to embodiments of the technology. Each example is provided by way of explanation of the technology only, not as a limitation of the technology. It will be apparent to those skilled in the art that various modifications and variations can be made in the present technology without departing from the scope or spirit of the technology. For instance, features described as part of one embodiment can be used on another embodiment to yield a still further embodiment. Thus, it is intended that the present technology cover such modifications and variations that come within the scope of the technology.

Figure 1:
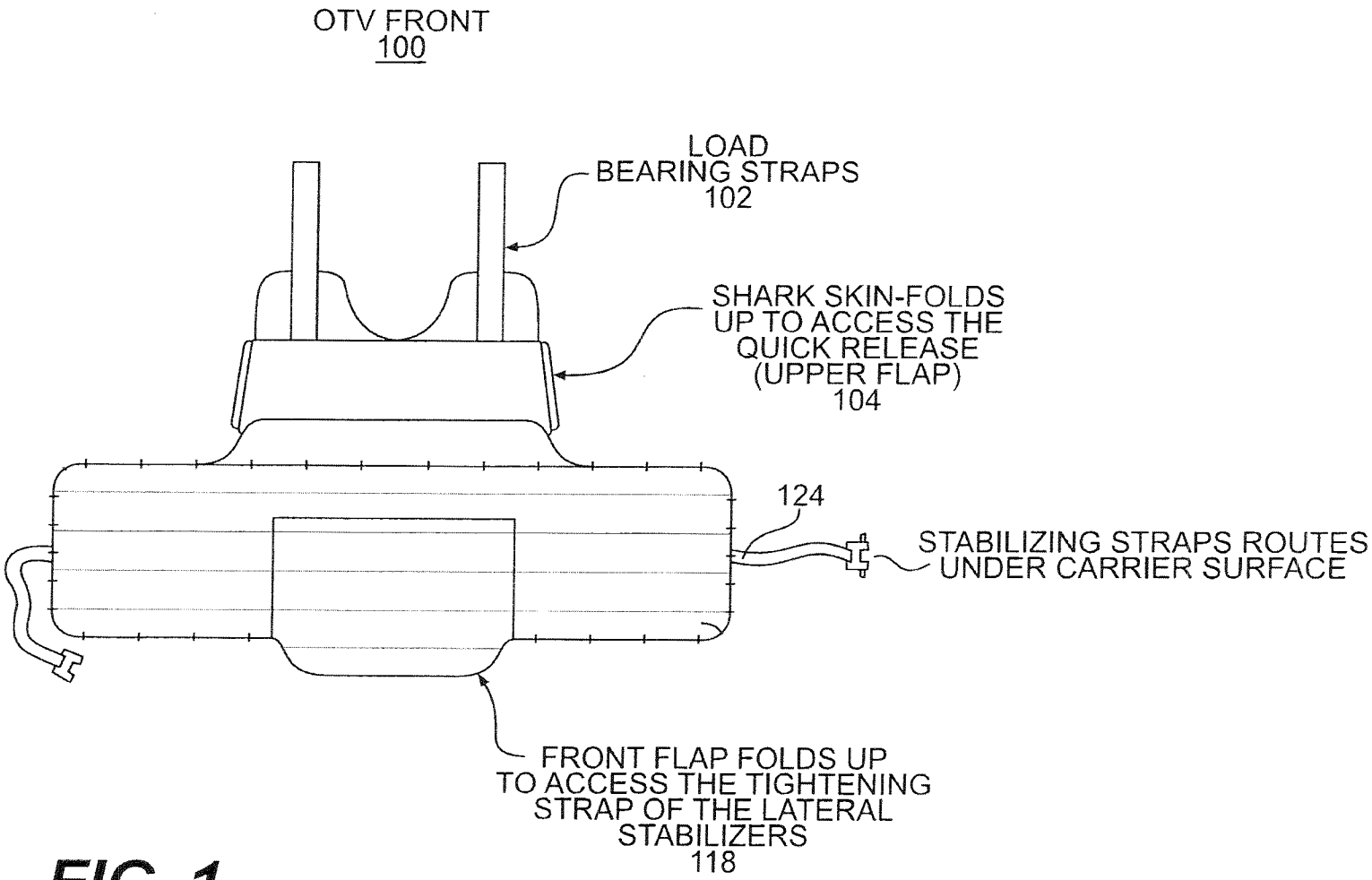
FIG. 1 illustrates a frontal view of embodiments of the technology.

Referring primarily to FIG. 1, a frontal view of the outer tactical vest (OTV) 100 of the technology is illustrated. Load bearing straps 102 are preferably 1" webbing, anchored under the mid-chest area under a "shark skin" flap 104 and running freely substantially directly upwards. These straps anchor a clip portion, preferably a portion of a Viper clip, and support at least a portion of the weight of the frontal load as it is transferred to lifts—of the upper yoke 2100 (not shown in this figure) of the frame 1300 (not shown in this figure).

Figure 3:
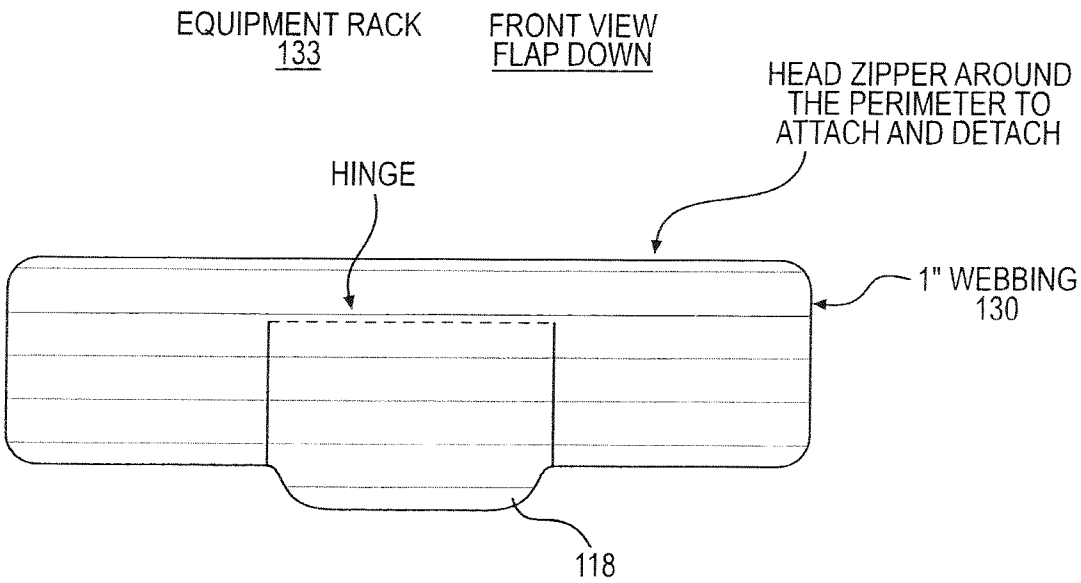
FIG. 3 illustrates elements of an equipment rack of the present technology.
Figure 4:
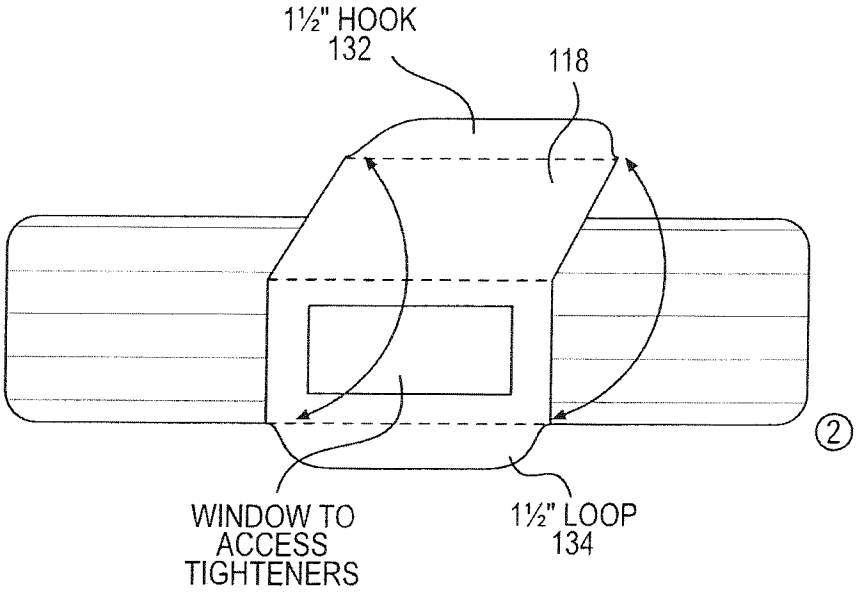
FIG. 4 illustrates flap detail of an equipment rack of the present technology.
Figure 5:
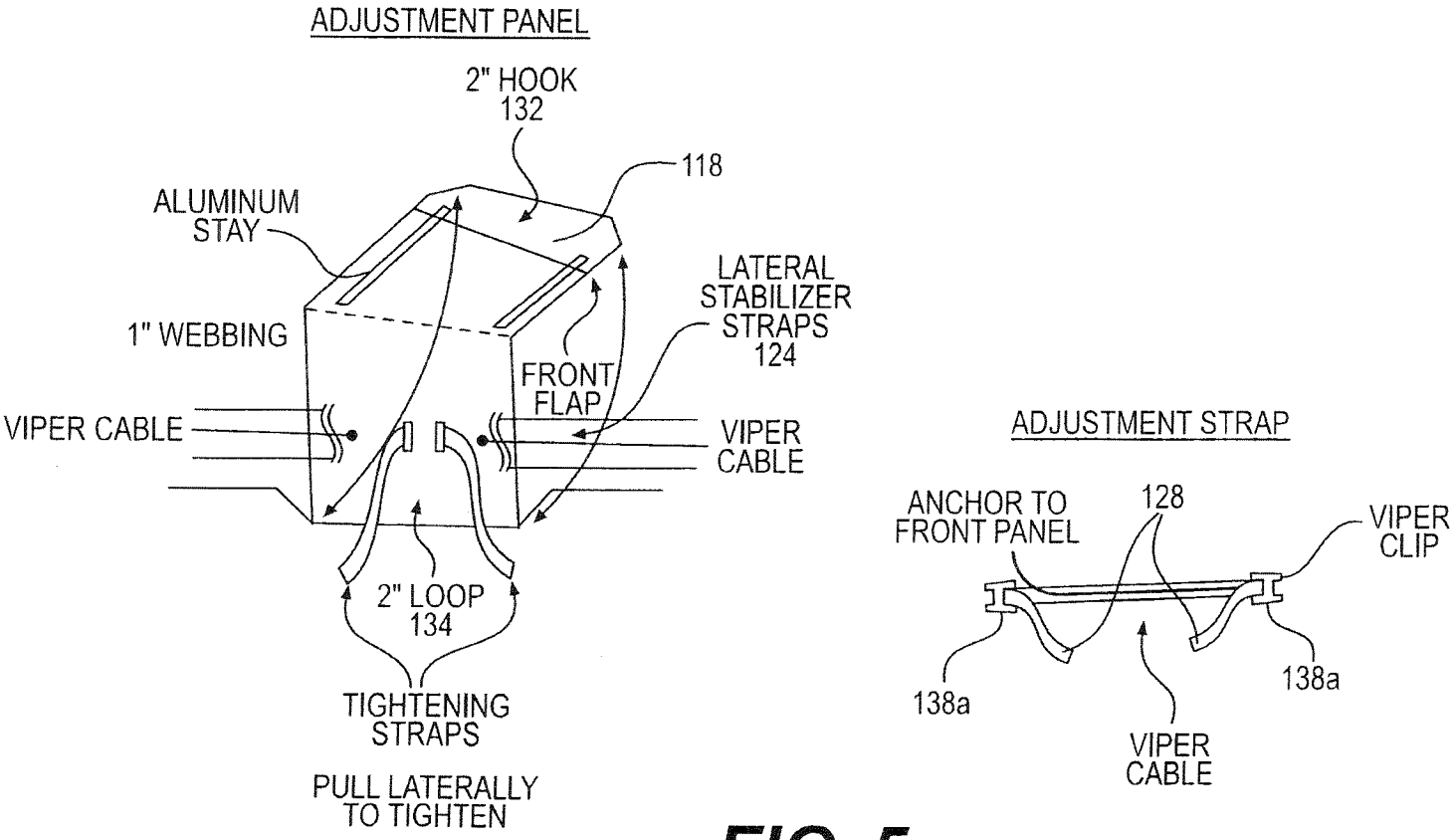
FIG. 5 illustrates elements of adjustment panel detail of an equipment rack of the present technology.

The OTV can be secured via clips—and stabilized laterally using stabilizing straps 124 that attach to mating clips. As shown in greater detail in FIGS. 3-5, an equipment rack 133 flap 118 opens, e.g., folds up for access to an adjustment mechanism for the stabilizing strap arrangement, e.g., the arrangement formed in some embodiments by the front stabilizing strap 124, rear stabilizing strap 126, an adjustment strap 128, and related clips. In preferred embodiments, the flap 118 is secured when closed, e.g., with a hook 132 and loop 134 means.

Figure 2:
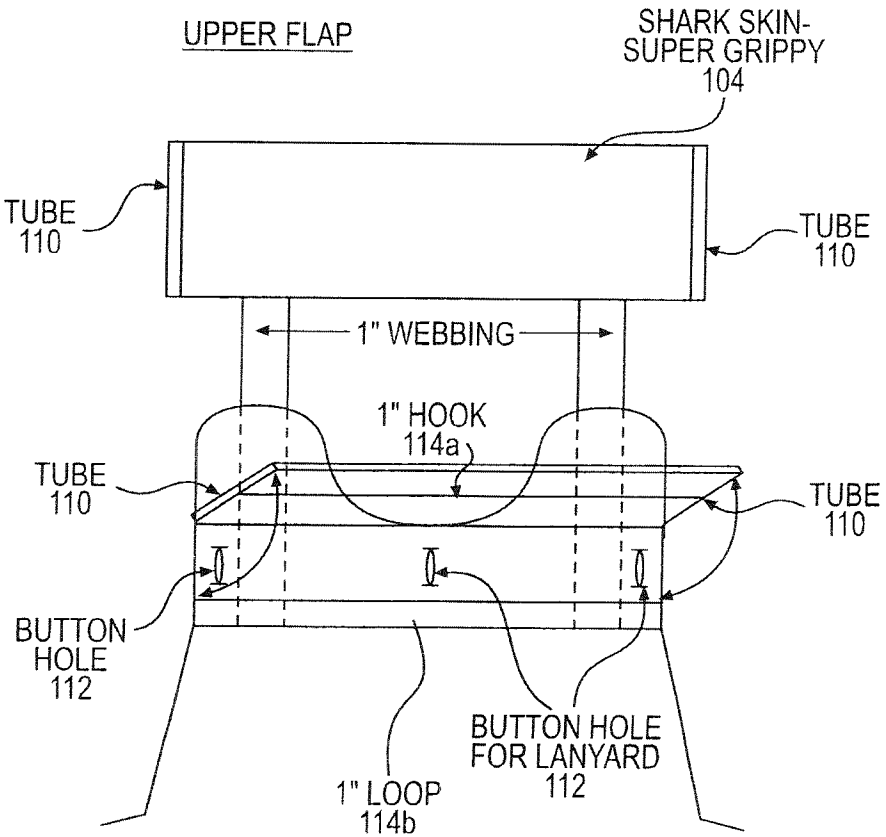
FIG. 2 illustrated detail of the upper flap region of embodiments of the technology.
Figure 6:
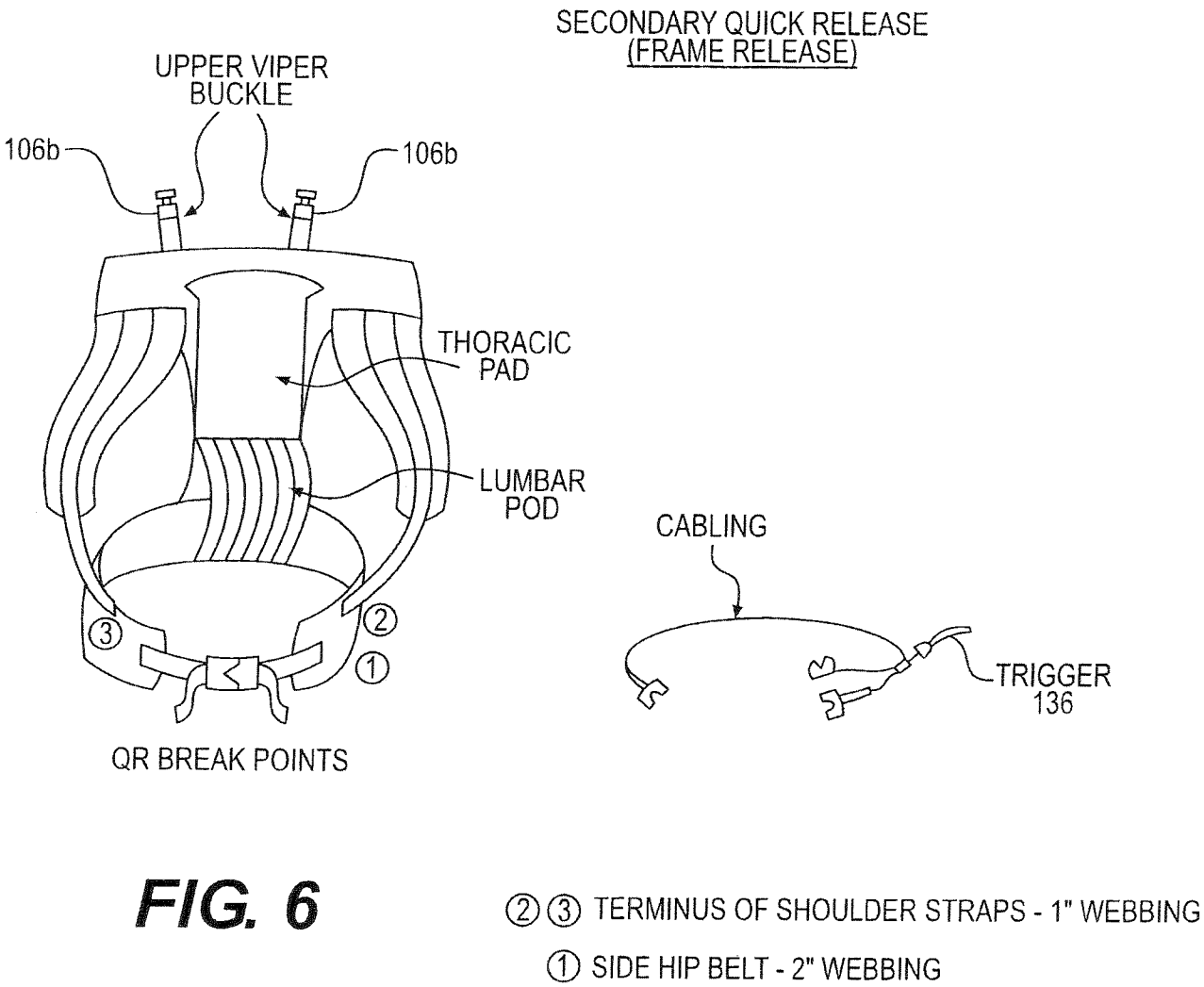
FIG. 6 illustrates elements of a quick release assembly of the present technology.

Referring to FIG. 2, detail of the upper flap region is shown. The shark skin flap 104 is preferably a 3" to 4" high strip that runs substantially the entire horizontal axis of a wearer's chest. The outer surface of the flap 104 is rough and "catchy" to allow a solid grip of a weapon's butt stock placed against the flap 104. This supports right, left, and center fire positions. The bilateral edge of this structure has a stop, preferably a wrapped tube 110 about ¾" diameter sewn vertically, to act as a barrier for a butt stock, so the butt stock is deterred from sliding laterally off of the shark skin flap 104. It serves as a landmark for weapon placement on the vest. The flap 104 folds upwards, preferably at the top seam, to allow access through one or more buttonholes 112 to features such as a quick release and remote trigger system, an example of which is illustrated in FIG. 6, located underneath it. The body of this foldable panel 104 can be secured, e.g., by hook 114*a* (shown on the underside of the flap 104) and loop 114*b* (shown on the front surface of the front thoracic yoke), buttons, or other fasteners known to those of skill in the art, but can be raised up, e.g., by grasping a lanyard of the remote trigger that can hang out of the bottom of the flap 104.

Equipment racks 133 of the technology are covered along the front with webbing, preferably one inch wide and attached to vest, e.g., sewn, at one inch intervals along the horizontal axis, to make the vest "MOLLE" friendly. The surface of the lower portion of the front is removable with a zipper or other mechanical attachment. The attachment will secure the panel substantially circumferentially and will bear substantially all the weight of the equipment placed on it. This will allow the equipment carrying portion of the vest to be removed and replaced at will. The equipment rack flap 118, or the "MAV RIG," flips up, e.g., on a hinge, which preferably is close to the upper edge of the flap 118. This flip exposes lateral stabilizer tightening straps 128 connected to front strap 124 and rear 126 straps to allow the vest to be tightened around a wearer's torso. These tightening straps can be attached, e.g., with one end, to a remote trigger 136, and the other end circles under the MAV RIG to the flap of the MAV. A pair of synch buckles 138*a*, 138*b*, at the medial position under this flap allows the wearer to grasp one strap in each hand and pull, e.g., back towards his sides, tightening the straps. In some embodiments, the buckles at the end of the stabilizing straps are a modified version of the COBRA buckle of AustriAlpin developed jointly with ARCHANGEL ARMOR, called the Viper Clip, which is attached directly to the remote trigger device 136 as shown in FIG. 6. With the MAV RIG removed, the wearer can access the lateral stabilizer buckle and webbing system and quick release and remote trigger system and interface.

Figure 7:
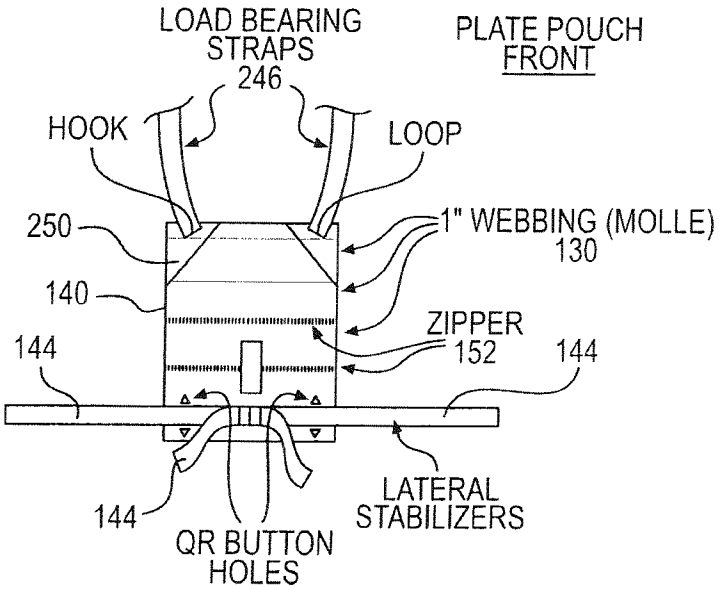
FIG. 7 illustrates elements of a plate pouch front of the present technology.

Referring primarily to FIG. 7, the plate pouch 140 can be removed from the carrier and attached directly to the frame 142 by the above means. The lateral stabilizers 144 can attach to synch straps at the bottom portion of the plate pouch 140. This will provide the same function on this configuration as on the full carrier configuration. Load bearing straps 246 are attached to the top corners of the plate pouch 140, and can normally be tucked in the envelope openings just behind the strap exit point of the plate pouch 140. The envelope openings allow the cables for the remote trigger 136 to pass through. The top lateral corners 250 of the plate pouch can seal themselves with hook and loop. This allows the pouches to accept different size and shape SAPI and SAPI type plates, where the hook and loop can reseal to hold multiple shape and curve scenarios. The zippers 152 on the plate pouch 140 front provide additional flexibility for sizing and attachment.

Figure 8:
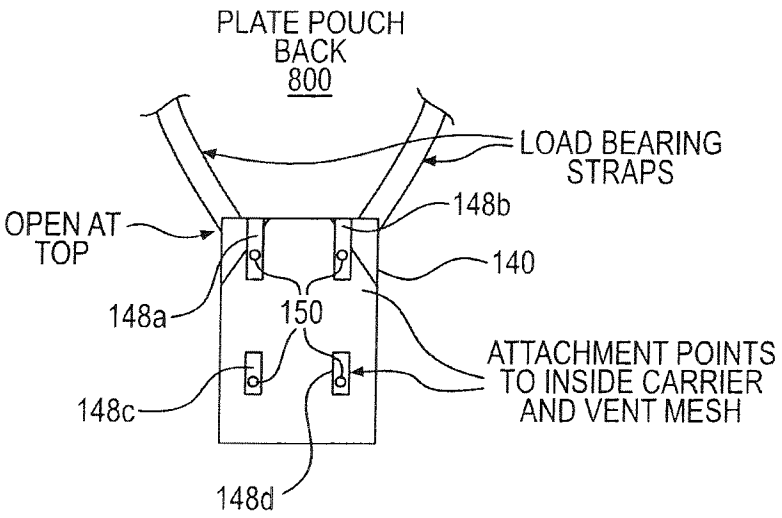
FIG. 8 illustrates elements of a plate pouch back of the present technology.
Figure 15:
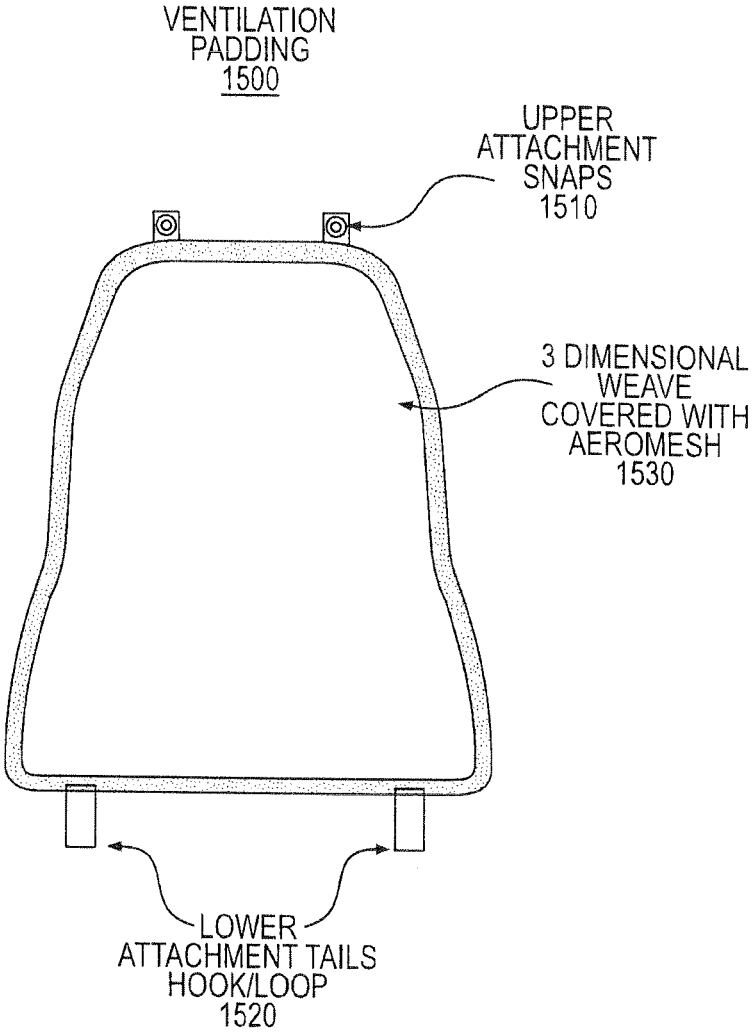
FIG. 15 illustrates elements of a ventilation system of the present technology.

The back side (or wearer side) 800, illustrated in FIG. 8, of the plate carrier 140 holds attachment points, e.g., four vertical strips of one inch webbing, one in each corner 148*a*, 148*b*, 148*c*, and 148*d*. The vertical webbing strips 148*a-d* are approximately four inches long and have a snap or like type device, which anchors the snap to the plate pouch. A one inch webbing strip about one and one half inches long oriented horizontally one inch lower than the upper anchoring point. This allows a "MOLLE" type interface for this attachment system onto the inside of the front or rear carriers, frame, and a ventilation system (portions of which are shown in FIG. 15). These attachment points also allow control over placement of the plate pouch 140 onto each of these mediums.

Figure 9:
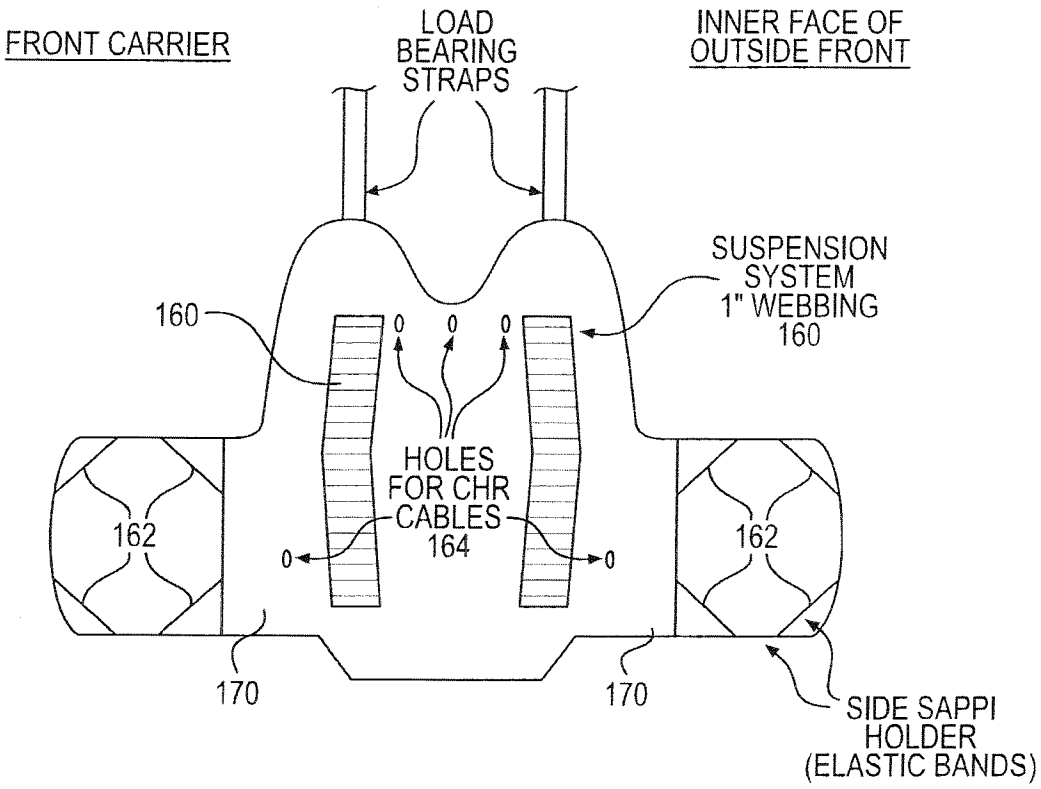
FIG. 9 illustrates elements of a front carrier of the present technology.

FIG. 9 illustrates the inside of a front carrier, which is the most outside layer that faces towards the wearer. There are two webbing strips 160, preferably two inches wide, that run vertically bilaterally of the medial vertical line. Each strip 160 can be covered with horizontally placed webbing strips, preferably one inch wide that lay perpendicularly to the vertical strips. The vertical strips are aligned with the one inch webbing strips on the plate carrier 140 to allow them to interface as an adjustable suspension system. Elastic bands 162 placed diagonally on the wings of the inside surface of the front carrier are used in securing SAPI armor. Button holes 164 for routing cabling for the remote release trigger 136 are placed about the inside of the front surface of the front carrier.

Figure 10:
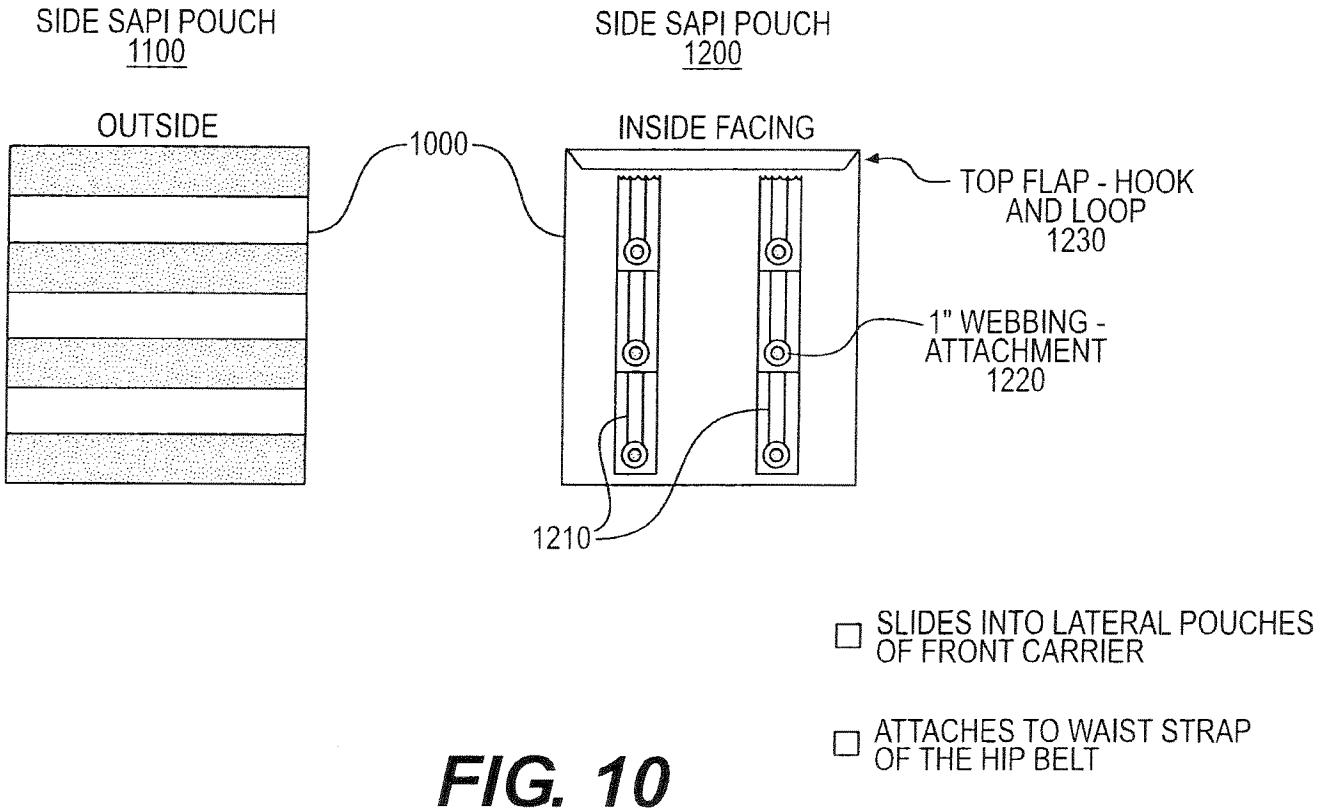
FIG. 10 illustrates elements of a side SAPI pouch of the present technology.

FIG. 10 illustrates a side SAPI pouch 1000. A SAPI pouch can be mounted to the front carrier on each of the lateral wrapping portions 170 of the front carrier in the OTV configuration, and will attach to webbing running horizontally on the hip belt 270 portion of the frame 142. The outer face of the pouch 1100 has webbing, e.g., one inch webbing, running horizontally at intervals across the face 1100 for engaging with MOLLE-friendly equipment. The inner face 1200 has two vertical lines of webbing 1210, preferably equidistant from the medial line, somewhat close to the edge of the pouch. Each line of webbing is divided into three flaps, attached to the pouch inner face 1200 at the top end of the webbing 1210. The bottom end of the webbing 1210 has a snap 1220 or other mechanical fastener, to allow the pouch 1000 to attach to a hip belt 270, e.g., on the horizontal webbing 272. The opening for the pouch is a flap 1230, preferably at the top seam, which can be open and closed with hook and loop.

Figure 11:
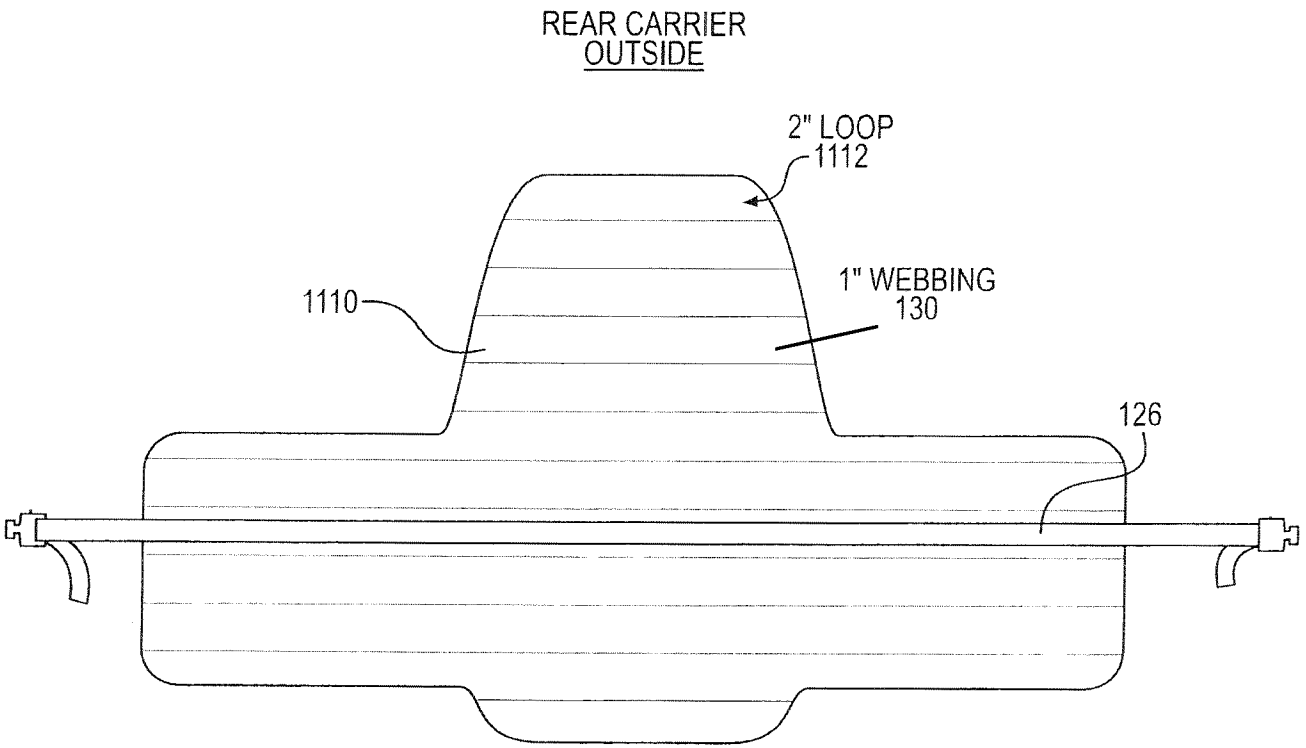
FIG. 11 illustrates elements of an outside face of a rear carrier of the present technology.

FIG. 11 illustrates a rear ballistic carrier 1100 that can hold a soft armor panel on the posterior of the frame. The outer face 1110 is cut to support the armor silhouette, for protection of the torso, and to wrap around each side. The outside is covered with horizontal rows of webbing 130 spaced one inch apart. The webbing is substantially secured with bar tack stitching everyone and one eighth inches to the fabric of the main carrier. The outside of the very top has a horizontal two inch strip of loop 1112 to accept standard military identification tapes. The rear portion of the device's lateral stabilizers 126 runs along the outside of the carrier horizontally. It allows engagement of the remote trigger 136 onto the stabilizers 126 for triggered release.

Figure 12:
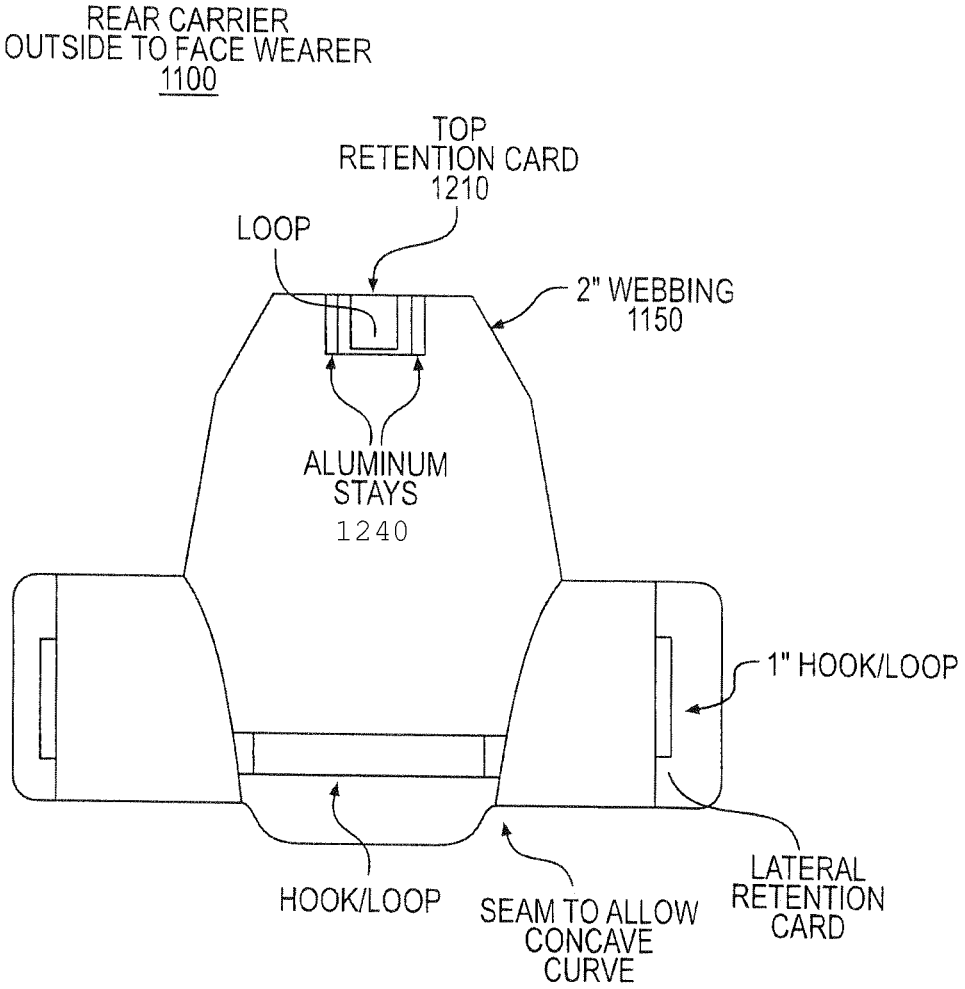
FIG. 12 illustrates elements of an inside face of a rear carrier of the present technology.

FIG. 12 illustrates the inside face of a rear carrier 1100 holds the attachment points for the frame. The central portion along the vertical axis is curved to allow a concave wrap around the wearer. Webbing 1150 running at a horizontal axis at the top seam provides a platform for the top attachment tab, e.g., consisting of a hardened plastic card 1210 reinforced with aluminum stays 1240. An envelope flap running horizontally close to the bottom of the panel to allow access to the inside of the carrier. The lateral attachments for the carrier to the frame are located close to the edges of the most lateral tabs. A vertical seam allows for the tabs on the hip belt of the frame in tuck into the accepting pouches, and be secured with hook and loop.

Figure 13:
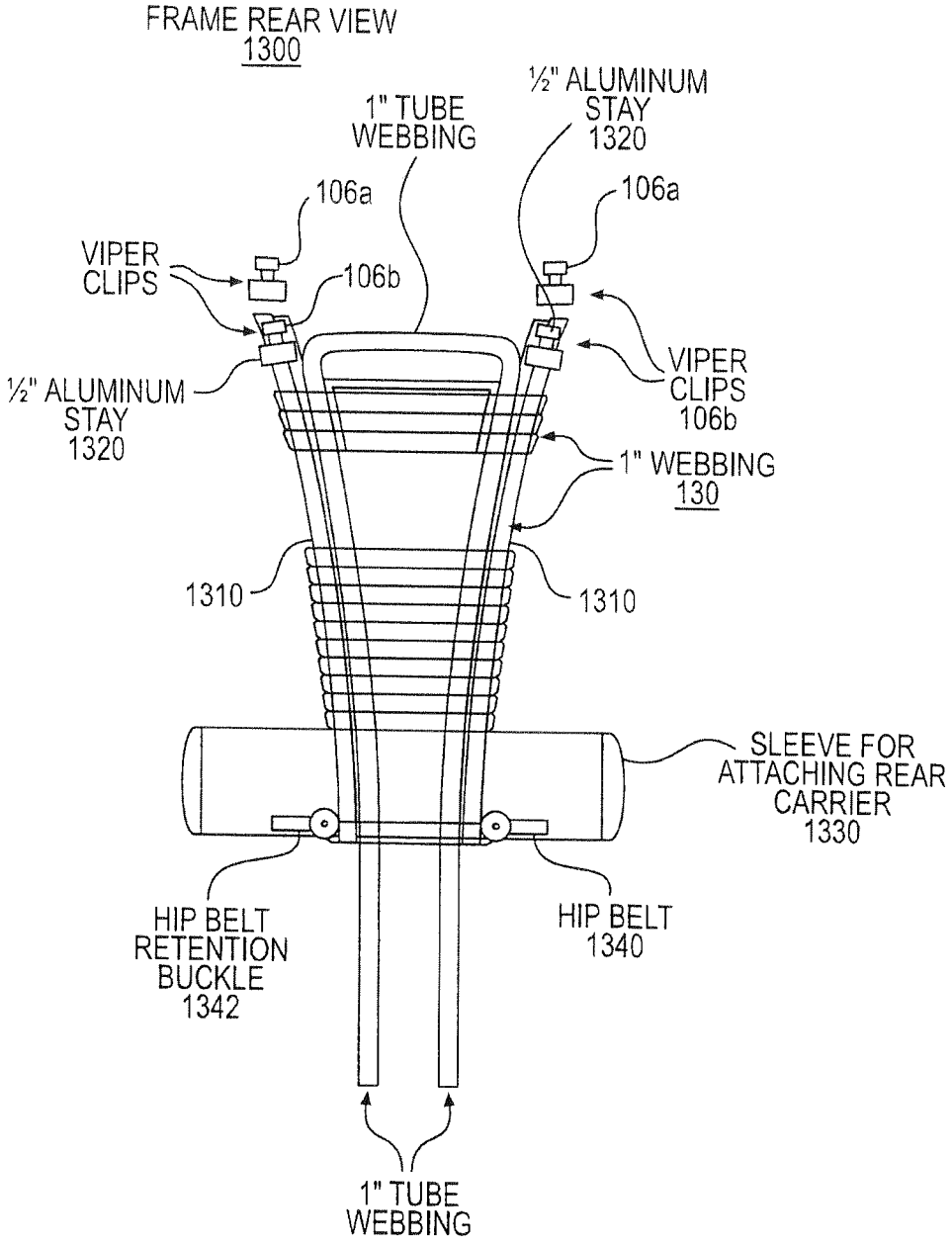
FIG. 13 illustrates elements of a frame of the present technology.

FIG. 13 illustrates a rear view of a frame 1300. The overall shape of the central portion echoes the shape of the human torso. Webbing 130 is deployed along the frame 1300. Frame members 1310, preferably semi-rigid, are topped with aluminum stays 1320. A sleeve 1330 for mounting a rear carrier can be found on each side of the lateral portion. A hip belt 1340 with hip belt retention buckle 1342 is provided. Viper clip portions 106*b* are shown at the top of the frame for mating with other Viper clip portions 106*a* from other vest elements as described herein.

Figure 14:
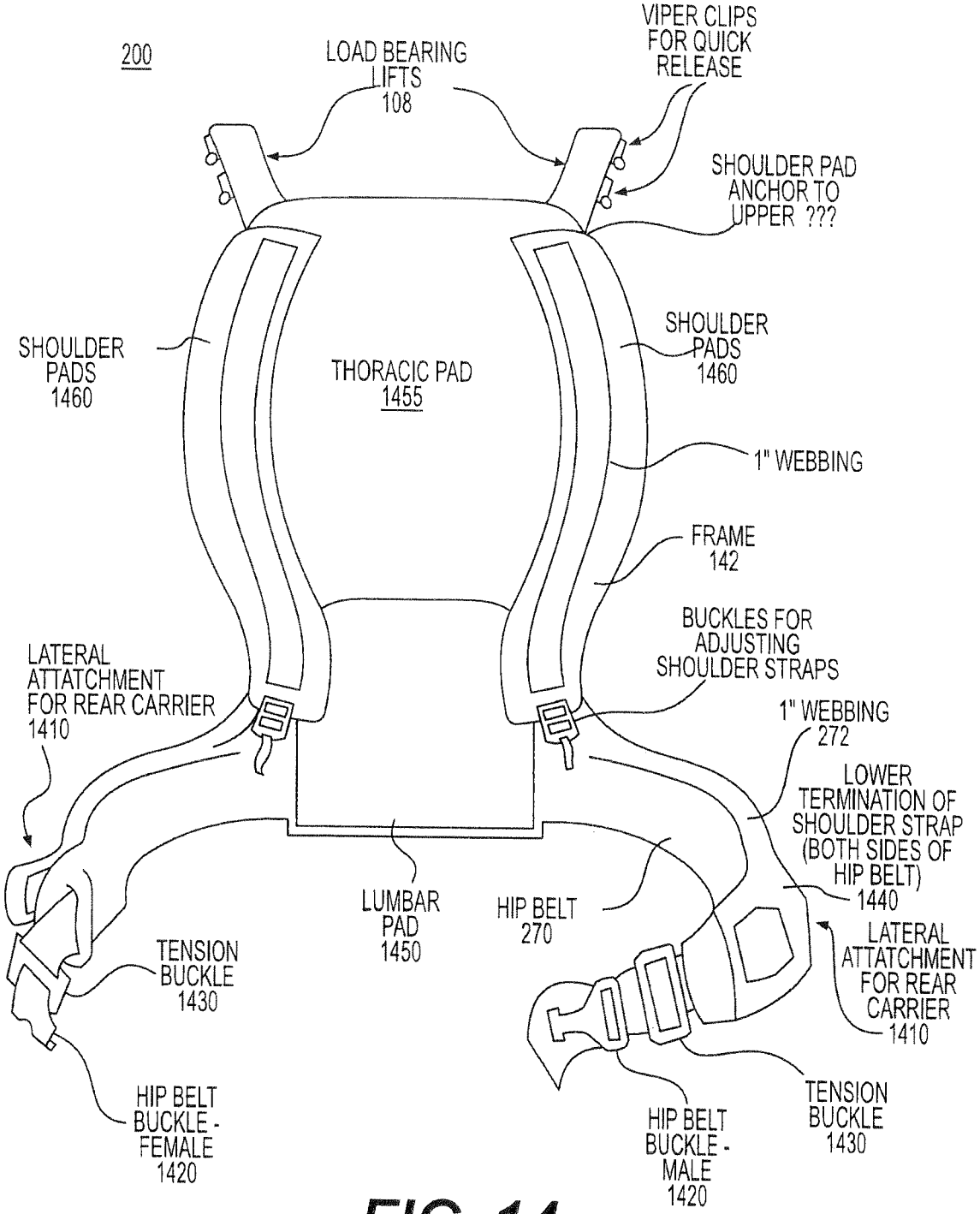
FIG. 14 illustrates elements of a carrier of the present technology.

FIG. 14 illustrates portions of embodiments of the present technology. Lateral attachment points 1410 for a rear carrier are shown proximate the exterior ends of a hip belt 270. The hip belt 270 includes terminating buckles 1420 and tension buckles 1430 for adjusting the belt. The assembly serves as an attachment point 1440 for the rear carrier. A lumbar pad 1450 and thoracic pad 1455 provide support to the wearer's back while shoulder pads 1460 cushion the portion of the load that is transferred to the wearer's shoulders. Load-bearing lifts 108 allow for the attachment of other equipment, e.g., evacuation harnesses.

FIG. 15 illustrates ventilation padding 1500 that can be placed between the wearer and the vest, either on the front or back of the wearer, through the use of attachment means. FIG. 15 shows two types of attachment means, snaps 1510 and 152 hook/loop 1520. Ventilation is facilitated by use of breathable materials, e.g., 3-dimensional weave covered with Aeromesh 1530.

Figure 16:
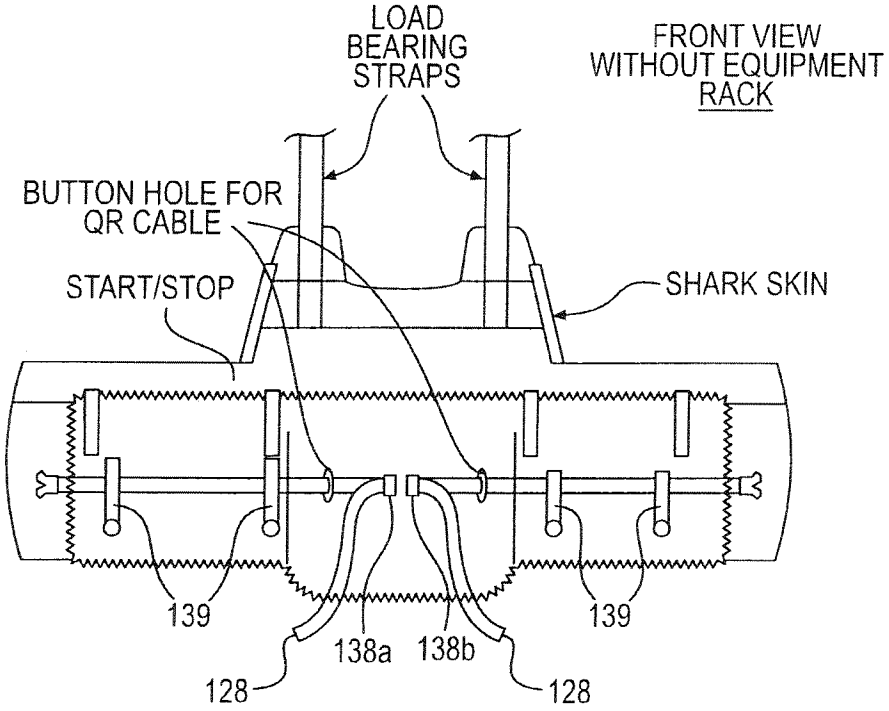
FIG. 16 illustrates elements an outer tactical vest of the present technology.

FIG. 16 illustrates a front view of the OTV without an equipment rack, showing adjustment lateral stabilizing straps 128 adjustable through synch buckles 138*a*, 138*b*. The strap 128 is shown threaded through guides 139.

Figure 17:
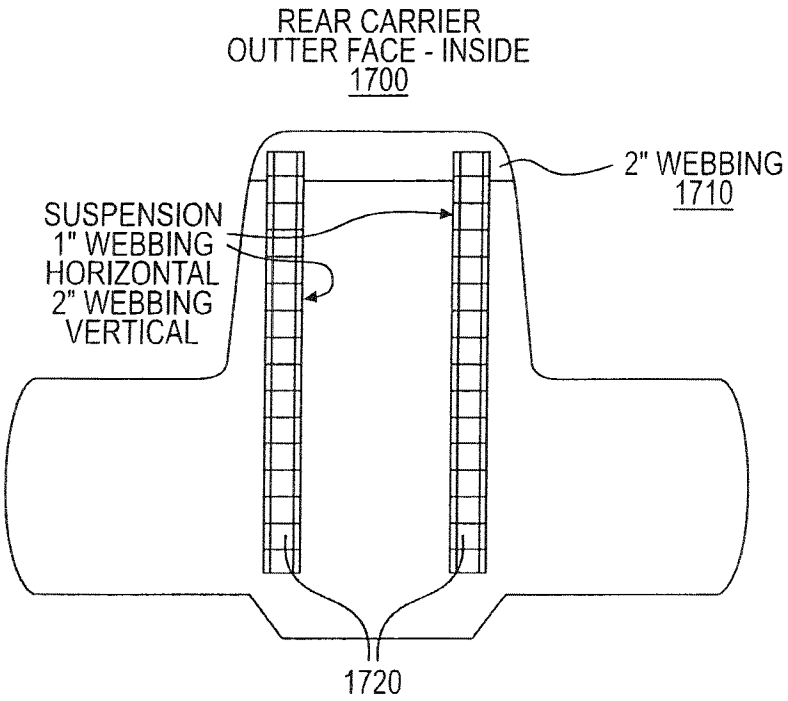
FIG. 17 illustrates elements of the inside face of an outer rear carrier of the present technology.

FIG. 17 illustrates the inside outer face of a rear carrier 1700 with webbing 1710 (preferably 2 inch) across the top and webbing 1720 (preferably one-inch horizontal and two inch vertical) in two vertical strips disposed substantially equidistant from the line of vertical symmetry of the carrier.

Figure 18:
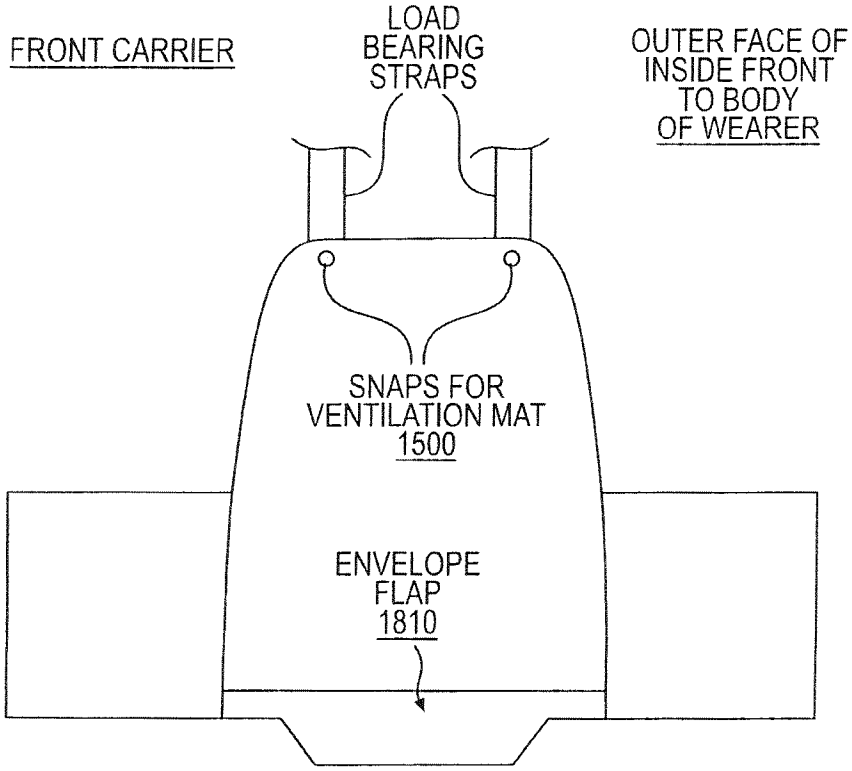
FIG. 18 illustrates elements of the outer face of an outer rear carrier of the present technology.

FIG. 18 illustrates the inside (toward the wearer) of a front carrier. An envelope flap 1810 provides an insertion/extraction point for armor. Attachment points, e.g., snaps, compatible with other modular element of the technology, e.g., ventilation padding 1500 are provided at the top.

Figure 19:
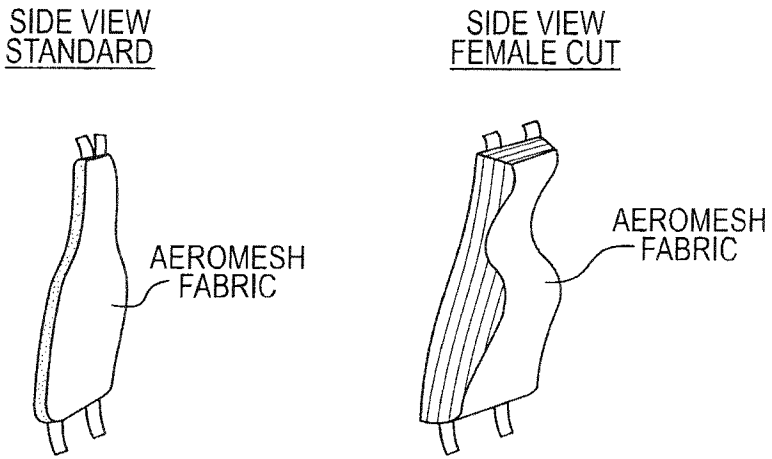
FIG. 19 illustrates elements of gender-specific padding of the present technology.
Figure 20:
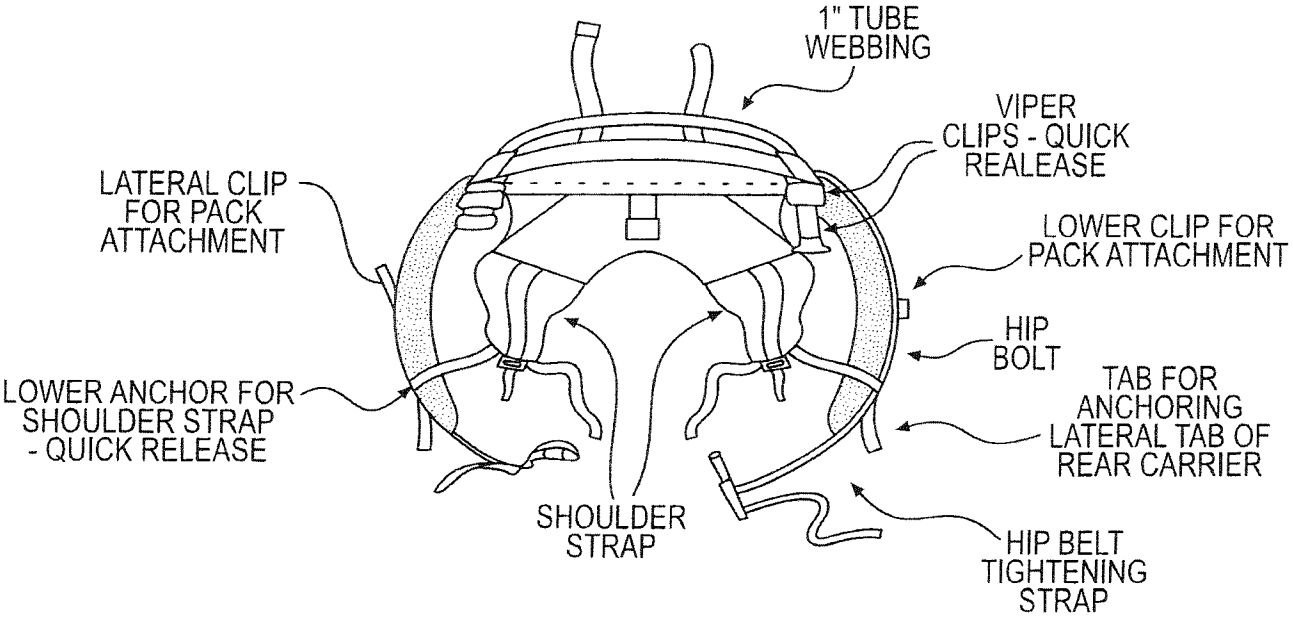
FIG. 20 illustrates a top view of a frame assembly of the present technology.

FIG. 19 illustrates gender-tailored padding for vest assemblies of the technology. FIG. 20 illustrates a top-down view of a frame assembly of the technology.

Figure 21:
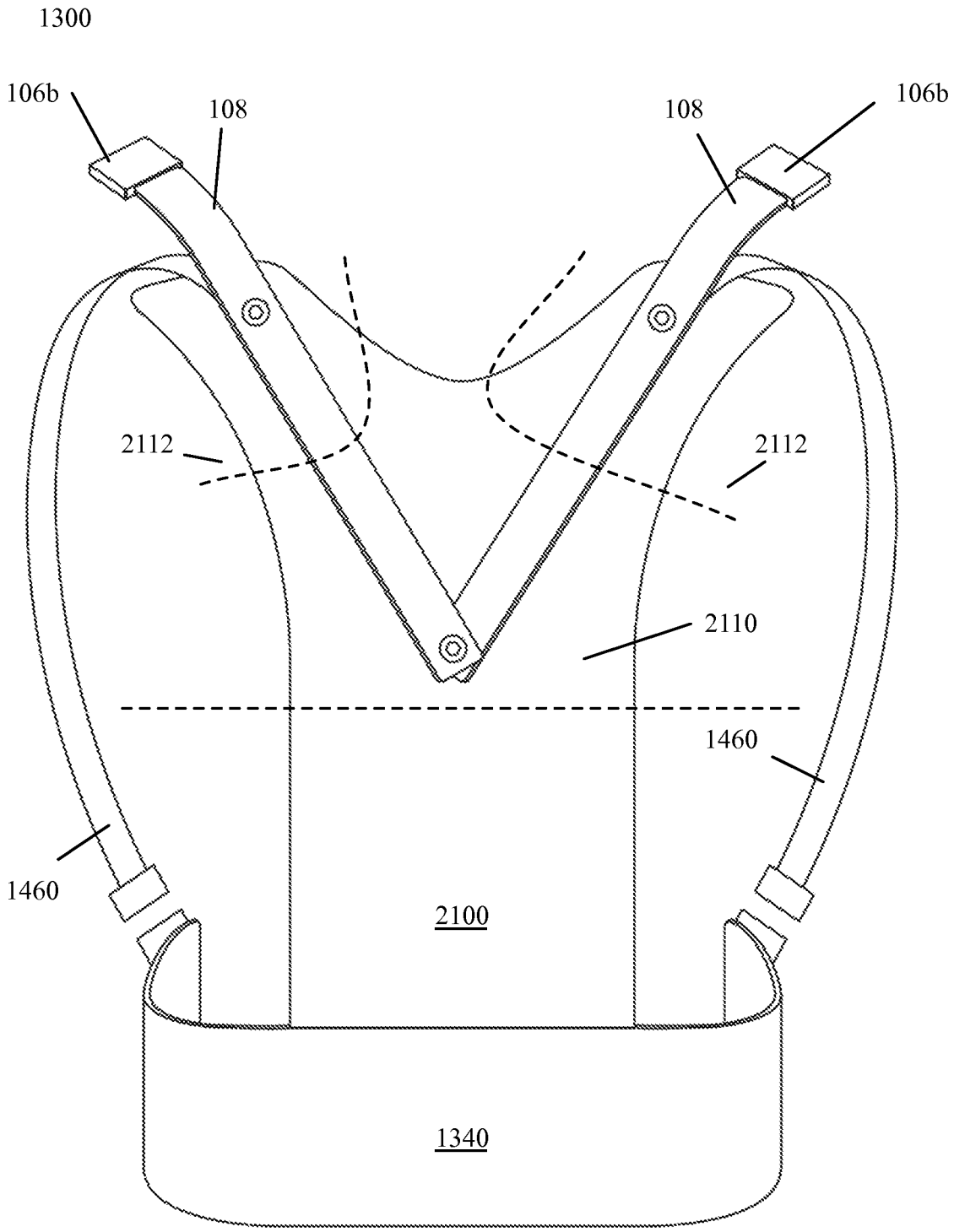
FIG. 21 illustrates load bearing extensions/lifts of the present technology in a rear view of the frame in schematic form.
Figure 22:
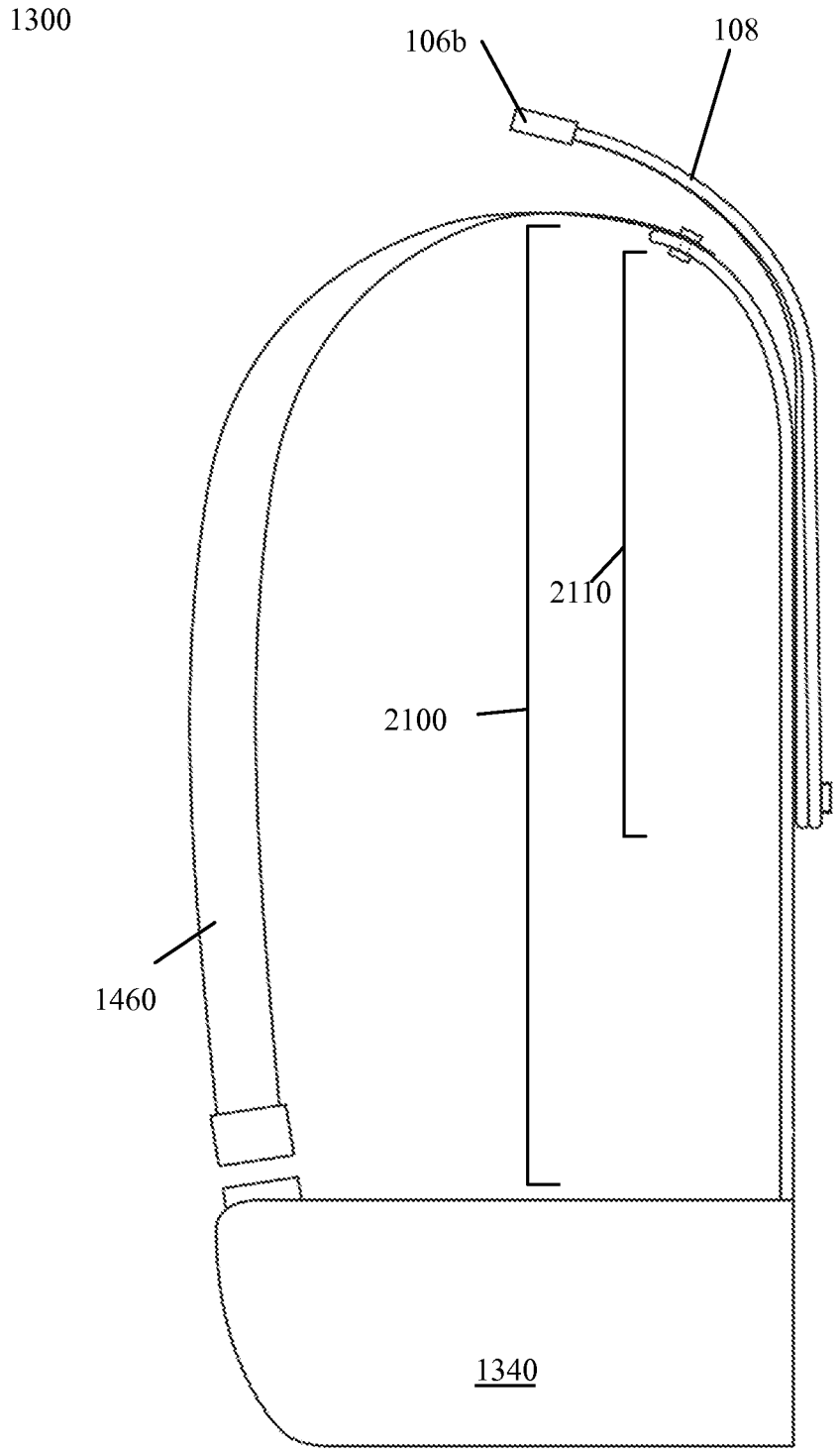
FIG. 22 illustrates load bearing extensions/lifts of the present technology in a left side view of the frame in schematic form.

FIG. 21 illustrates load bearing extensions/lifts of the present technology in schematic form. FIG. 22 illustrates load bearing extensions/lifts of the present technology in a left side view of the frame 1300 in schematic form.

The load bearing vest frame assembly 1300 includes a hip assembly 1340, a yoke assembly 2100, a first and a second shoulder strap assembly 1460. The hip assembly 1340 is configured to at least substantially surround the hips of a wearer. The yoke assembly 2100 is attached to a rear portion of the hip assembly 1340. The yoke assembly 2100 configured to extend therefrom up the back of the wearer. The yoke assembly 2100 includes first and a second load bearing extension 108, and can be characterized by an upper yoke assembly 2110 comprising a first lateral and a second lateral portion 2112.

Each collective shoulder strap assembly 1460 and upper yoke assembly lateral portion 2112 is configured to extend from a first shoulder blade region of the wearer, over a first shoulder of the wearer, down the front torso of the wearer. Each load bearing extension 108 is extended over, and at a distance from, a collective shoulder strap assembly 1460 and upper yoke assembly first lateral portion 2112, and is terminated in a releasable connector compatible with a carrier releasable connector at a point in the vicinity of the top of one shoulder of the wearer.

In some embodiments, the frame includes at least one vertical releasable connection positioned on the hip assembly at the front side of the wearer. In such embodiments, a second end of each shoulder strap assembly is connected to an upper yoke assembly lateral portion, each shoulder strap assembly comprises, proximate a first end of the each shoulder strap assembly, a releasable connection compatible with the at least one vertical releasable connection of the hip assembly.

In some embodiments, lifts/load bearing extension consists of 60/1000 plastic frame sheets—re-enforced with ⅜" carbon stays, which run the entire length of the yoke through the stay tube. 1" webbing is attached with the loose end anchoring the load bearing straps and attachment buckles (Cobra type) over each shoulder.

I claim:

1. A load bearing vest frame assembly comprising:

a hip assembly, a yoke assembly, a first shoulder strap assembly, and a second shoulder strap assembly;

the hip assembly is adapted to be shaped substantially to a hip of a wearer;

the yoke assembly attached to a rear portion of the hip assembly, extends therefrom up the back of the wearer, and comprising a first load bearing extension, a second load bearing extension, and an upper yoke assembly comprising a first lateral portion and a second lateral portion; and wherein:

the combined first shoulder strap assembly and upper yoke assembly first lateral portion adapted to extend from a first shoulder blade region of the wearer, over a first shoulder of the wearer, down the front torso of the wearer;

the combined second shoulder strap assembly and upper yoke assembly second lateral portion adapted to extend from a second shoulder blade region of the wearer, over a second shoulder of the wearer, down the front torso of the wearer;

the first load bearing extension extended over, and at a distance from, the combined first shoulder strap assembly and upper yoke assembly first lateral portion, and terminats in a releasable connector compatible with a carrier releasable connector at a point in the vicinity of the top of the first shoulder of the wearer; and the second load bearing extension extends over, and at a distance from, the combined second shoulder strap assembly and the upper yoke assembly second lateral portion, and terminates in a releasable connector compatible with a carrier releasable connector at a point in the vicinity of the top of the second shoulder of the wearer.

2. The load bearing vest frame assembly of claim 1:

further comprising at least one vertical releasable connection positioned on the hip assembly at the front side of the wearer; and wherein:

a second end of the first shoulder strap assembly is connected to the upper yoke assembly first lateral portion;

a second end of the second shoulder strap assembly is connected to the upper yoke assembly second lateral portion; and first and second strap assembly comprises, proximate a first end of the combined second shoulder strap assembly and, a releasable connection compatible with the at least one vertical releasable connection of the hip assembly.

3. A load bearing vest assembly comprising:

a frame assembly and a carrier;

the carrier comprising a carrier releasable connector in each area of the carrier adapted to correspond to a shoulder of a wearer of the vest assembly;

the frame assembly comprising a hip assembly, a yoke assembly, a first shoulder strap assembly, and a second shoulder strap assembly;

the hip assembly is adapted to be shaped substantially to a hip of a wearer of a wearer;

the yoke assembly attached to a rear portion of the hip assembly, extends therefrom up the back of the wearer, and comprising a first load bearing extension, a second load bearing extension, and an upper yoke assembly comprising a first lateral portion and a second lateral portion; and wherein:

the combined first shoulder strap assembly and upper yoke assembly first lateral portion adapted tp extends from a first shoulder blade region of the wearer, over a first shoulder of the wearer, down the front torso of the wearer;

the combined second shoulder strap assembly and upper yoke assembly second lateral portion adapted to extends from a second shoulder blade region of the wearer, over a second shoulder of the wearer, down the front torso of the wearer;

the first load bearing extension extends over, and at a distance from, the combined first shoulder strap assembly and upper yoke assembly first lateral portion, and terminates in a releasable connector compatible with the carrier releasable connector at a point in the vicinity of the top of the first shoulder of the wearer; and the second load bearing extension extends over, and at a distance from, the collective other upper yoke assembly second lateral portion, and terminates in a releasable connector compatible with the carrier releasable connector at a point in the vicinity of the top of the second shoulder of the wearer.

* * * * *